US012247349B2

(12) United States Patent
Fidanza et al.

(10) Patent No.: US 12,247,349 B2
(45) Date of Patent: Mar. 11, 2025

(54) METHOD OF PRODUCING A SUPPORT FOR POLYURETHANE-BASED IMITATION LEATHER FREE OF DIMETHYLFORMAMIDE (DMFa) OR OTHER SOLVENTS OR WATER, AND RELATED METHOD OF PRODUCING AN IMITATION LEATHER

(71) Applicant: CONDOR TRADE S.R.L., Brescia (IT)

(72) Inventors: Virginio Abbondio Fidanza, Brescia (IT); Emanuele Ventura, Brescia (IT)

(73) Assignee: CONDOR TRADE S.R.L., Brescia (IT)

( * ) Notice: Subject to any disclaimer, the term of this patent is extended or adjusted under 35 U.S.C. 154(b) by 197 days.

(21) Appl. No.: 17/800,972

(22) PCT Filed: Feb. 11, 2021

(86) PCT No.: PCT/IB2021/051115

§ 371 (c)(1),
(2) Date: Aug. 19, 2022

(87) PCT Pub. No.: WO2021/165794

PCT Pub. Date: Aug. 26, 2021

(65) Prior Publication Data

US 2023/0064200 A1 Mar. 2, 2023

(30) Foreign Application Priority Data

Feb. 19, 2020 (IT) ..... 102020000003401

(51) Int. Cl.
*D06N 3/14* (2006.01)
*D06N 3/00* (2006.01)

(52) U.S. Cl.
CPC ..... *D06N 3/147* (2013.01); *D06N 3/0006* (2013.01); *D06N 3/0011* (2013.01);
(Continued)

(58) Field of Classification Search
None
See application file for complete search history.

(56) References Cited

U.S. PATENT DOCUMENTS

2008/0214727 A1* 9/2008 Pohl ..... C08G 18/10 524/589
2013/0129960 A1* 5/2013 Schaefer ..... B32B 5/28 428/207

(Continued)

FOREIGN PATENT DOCUMENTS

CN 101137506 A 3/2008
CN 102758360 B 4/2014

(Continued)

OTHER PUBLICATIONS

Machine translation KR20010084062A (Year: 2001).*

(Continued)

*Primary Examiner* — Jacob T Minskey
*Assistant Examiner* — Wayne K. Swier
(74) *Attorney, Agent, or Firm* — Merchant & Gould P.C.

(57) ABSTRACT

A method for producing a support for polyurethane-based imitation leather free of dimethylformamide or other solvents or water involves preparing a base. A two-component polyurethane layer is sprayed on the base which includes preparing a first component and a second component. The first and second components are combined to obtain a mixture, and the mixture is sprayed uniformly on the base forming the polyurethane layer. A backing is applied on the two-component polyurethane layer forming a support and the support is dried.

20 Claims, 11 Drawing Sheets

(52) U.S. Cl.
CPC ..... *D06N 3/0077* (2013.01); *D06N 3/0097* (2013.01); *D06N 2203/068* (2013.01); *D06N 2205/16* (2013.01); *D06N 2213/03* (2013.01)

(56) References Cited

U.S. PATENT DOCUMENTS

| | | | | |
|---|---|---|---|---|
| 2014/0215850 | A1 | 8/2014 | Redl | |
| 2018/0202101 | A1* | 7/2018 | Seong | B32B 5/00 |

FOREIGN PATENT DOCUMENTS

| | | | | | |
|---|---|---|---|---|---|
| CN | 103797184 | A | | 5/2014 | |
| CN | 104878615 | A | | 9/2015 | |
| CN | 106113859 | A | | 11/2016 | |
| CN | 102758359 | A | | 10/2021 | |
| GB | 2132940 | A | * | 7/1984 | B32B 27/10 |
| KR | 2001-0084062 | A | * | 9/2001 | C14B 7/02 |
| WO | WO-9700170 | A1 | * | 1/1997 | A47B 21/0371 |

OTHER PUBLICATIONS

Machine translation CN102758359A (Year: 2012).*
Machine translation CN102758360B (Year: 2014).*
Machine translation CN103797184A (Year: 2014).*
Machine translation CN104878615A (Year: 2015).*
International Search Report and Written Opinion of the International Searching Authority for International Patent Application No. PCT/IB2021/051115 mailed Jun. 4, 2021, 9 pages.
Chinese Office Action received for CN Application No. 202180015810.2 on Dec. 13, 2023, 10 pgs.

* cited by examiner

METHOD OF PRODUCING A SUPPORT FOR POLYURETHANE-BASED IMITATION LEATHER FREE OF DIMETHYLFORMAMIDE (DMFa) OR OTHER SOLVENTS OR WATER, AND RELATED METHOD OF PRODUCING AN IMITATION LEATHER

CROSS-REFERENCE TO RELATED APPLICATIONS

This application is a National Stage Application of PCT/IB2021/051115, filed 11 Feb. 2021, which claims benefit of Ser. No. 10/202,0000003401, filed 19 Feb. 2020 in Italy and which applications are incorporated herein by reference. To the extent appropriate, a claim of priority is made to each of the above disclosed applications.

FIELD OF THE INVENTION

The present invention relates to a method of producing a support for polyurethane-based imitation leather free of dimethylformamide (DMF a) or other solvents or water, and to a related method of producing an imitation leather free of dimethylformamide (DMFa) or other solvents.

BACKGROUND OF THE INVENTION

Faux leather or imitation leather is a synthetic leather which can have an appearance similar to that of natural hide or leather, or it can be made with a certain grain even different from leather, for example with technical designs and the like.

Imitation leather consists of a polymer in the base form of simple film, to which a fabric or a nonwoven fabric (NWF) in natural fibers (e.g., cotton, linen or the like), or synthetic fibers (e.g., polyester, polyamide, and the like) or a combination thereof, or a coagulate can be applied thereto, i.e., a fabric/NWF on which a polymeric material has been impregnated or spread.

The production of imitation leather usually occurs by multilayer spreading. The process initially includes a plurality of steps of spreading various layers which will go to form the final product. Such layers are spread on a release paper support using a blade. In the final step of the process, a textile support or an NWF support or a coagulated support is applied to the plurality of layers by means of an adhesive. Finally, a printing finishing process, or an embossing, or an application of transfer papers or foils can follow if the aesthetic effect of the fabric is to be enhanced.

The coagulate is an essential element of the production process of polyurethane imitation leather, as it serves to give thickness and mechanical features to the finished product.

The coagulate is a base composed of a fabric/NWF and aromatic polyurethane in dimethylformamide (DMFa) or other solvents or in water.

Such a type of coagulate is therefore composed of fabric/NWF impregnated with coagulated polyurethane or fabric/NWF to which a layer of coagulated polyurethane is applied directly to the surface using a blade. The coagulation by impregnation occurs in a special line where the fabric/NWF, which will form the final support, is placed in a tank containing the polyurethane solution in DMFa or solvents. The fabric, which remains impregnated with the desired amount, is then immersed in a coagulation tank in which the polyurethane, deprived of the solvent, coagulates since the DMFa, being very hydrophilic, is violently captured by the water. Next, for the complete elimination of the DMFa, the coagulated fabric/NWF undergoes various washing cycles with counter-current water. Finally, after careful squeezing, the product passes through a special dryer for complete drying and the subsequent rolling.

Despite the various washing cycles, the final coagulate maintains a high concentration of DMFa or other solvents, i.e., between 400 and 800 ppm (i.e., mg/kg). Such a percentage is no longer acceptable, as DMFa is highly toxic and dangerous, and there are numerous regulations limiting the presence thereof in fabrics.

Imitation leather production methods are known in the field, which include using polyurethane free of dimethylformamide (DMFa), as described in documents CN 102 758 359 A and CN 102 758 360 B. Such documents describe a method of applying a two-component polyurethane which requires a mechanical leveling carried out by a blade. It is apparent that the contact between the blade and the polyurethane material being solidified involves an accumulation in little time of residues of solidified material below the blade until they completely obstruct the passage opening for the sliding of the material still under reaction. This results in continuous machine stops to allow the cleaning or replacement of the blade itself. Such an aspect is particularly disadvantageous and is common to all the methods of applying polyurethane with mechanical leveling.

SUMMARY OF THE INVENTION

It is the object of the present invention to solve the problems associated with the use of DMFa and other solvents for producing imitation leather, thus also reducing the emissions which are difficult to detect and allowing a high saving of caloric energy.

Therefore, it is an object of the present invention to obtain a replacement support of the coagulate for producing imitation leather, which is free of DMFa or other solvents or water.

In particular, it is the object of the present invention to provide a new method of producing a support for polyurethane-based imitation leather free of DMFa or other solvents or water, and a related new method of producing an imitation leather free of DMFa or other solvents.

Such an object is achieved by a method of producing a support for polyurethane-based imitation leather free of DMFa or other solvents or water, and by a related method of producing an imitation leather free of DMFa or other solvents as described herein.

BRIEF DESCRIPTION OF THE FIGURES

The features and advantages of the method according to the present invention will become apparent from the following description, given by way of non-limiting example in accordance with the accompanying drawings, in which.

DETAILED DESCRIPTION

Figure 1A:
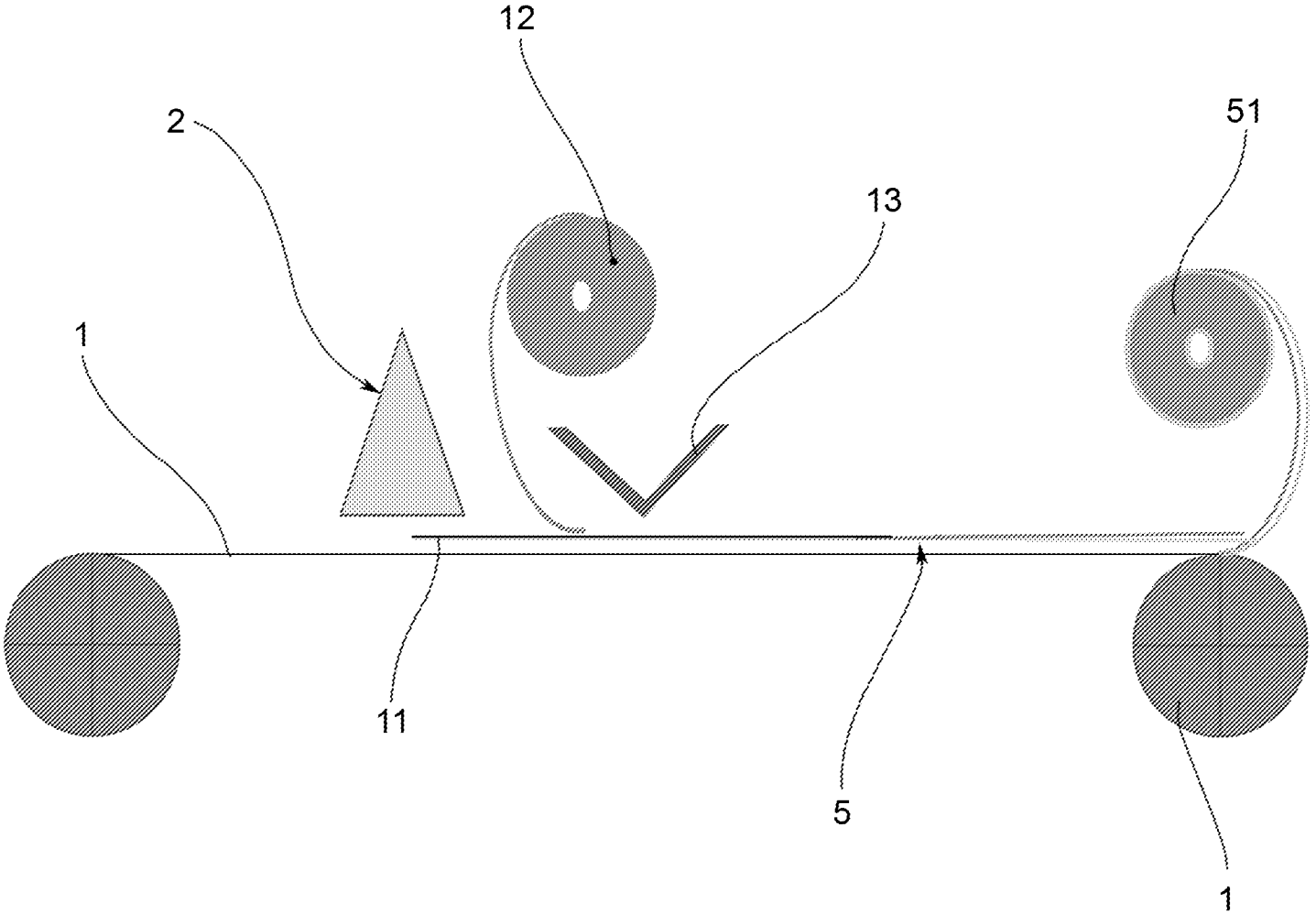
FIG. 1A diagrammatically shows a method of producing a support for imitation leather according to the present invention, in an embodiment.

It is an object of the present invention to obtain a replacement support of the coagulate, that is to say a polyurethane-based support for imitation leather free of dimethylformamide (DMFa) or other solvents or water. The new support is obtained with a method in accordance with the present invention which includes using a two-component polyurethane applied homogeneously on a base. The method provides for the reaction between the two components occurring by using a high or low pressure machine (with or without mixer) and for the mixture being immediately uniformly distributed on the base by spraying.

The two-component polyurethane 11 used is obtained from the synthesis of two components: component A and component B.

Component A is an isocyanate, preferably diphenylmethane diisocyanate (MDI) partially reacted with polyesters or polyethers.

Component B is a polyether-based or polyester-based polyol.

Preferably, the components A and B have the following properties:

| | Unit | Component B | Component A | Method |
|---|---|---|---|---|
| Viscosity 25/25° C. | Cps | 1020 +/− 100 | 1130 +/− 100 | ASTM D 445 |
| Specific weight 25/25° C. | g/cm$^3$ | 1.02 +/− 0.2 | 1.19 +/− 0.2 | ASTM D 891 |

The mixing ratio by weight between component B (polyol) and component A (isocyanate) is preferably between 100:30 and 100:120.

The reaction between the components A and B occurs at high or low pressure.

The two-component polyurethane 11 is deposited uniformly on the base through a spray system indicated by reference numeral 2 in the drawings. The system 2 mixes the components A and B, making them collide at high pressure, or at low pressure by using a mixer, then depositing the two-component mixture through a spray. Advantageously, the method according to the present invention provides that the mixture of components A and B is uniformly sprayed without the need for any mechanical spreading or leveling.

Figure 8:
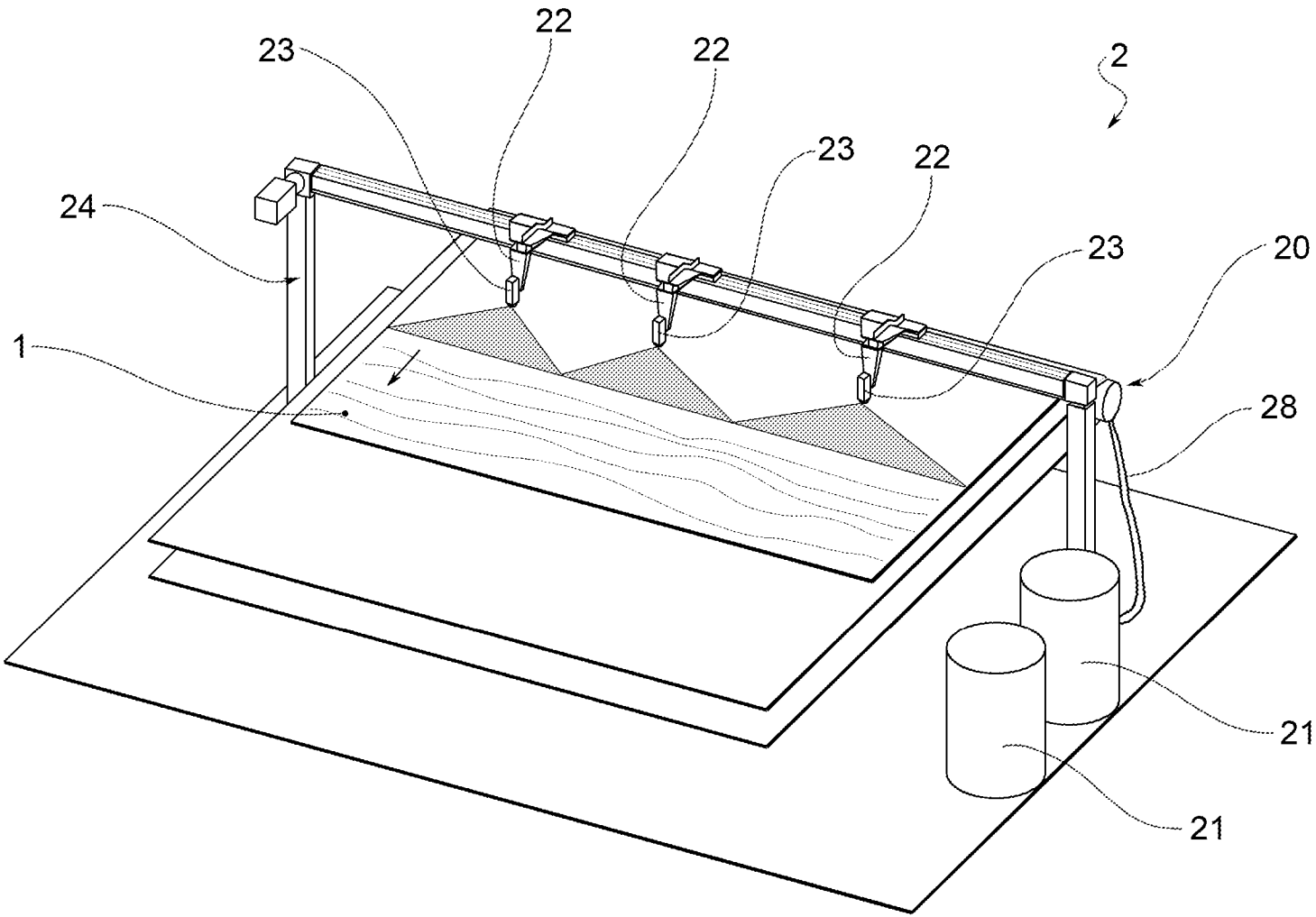
FIG. 8 diagrammatically shows a step of spray distributing a polyurethane layer for producing a support for imitation leather or for producing imitation leather according to the present invention, in an embodiment.
Figure 9:
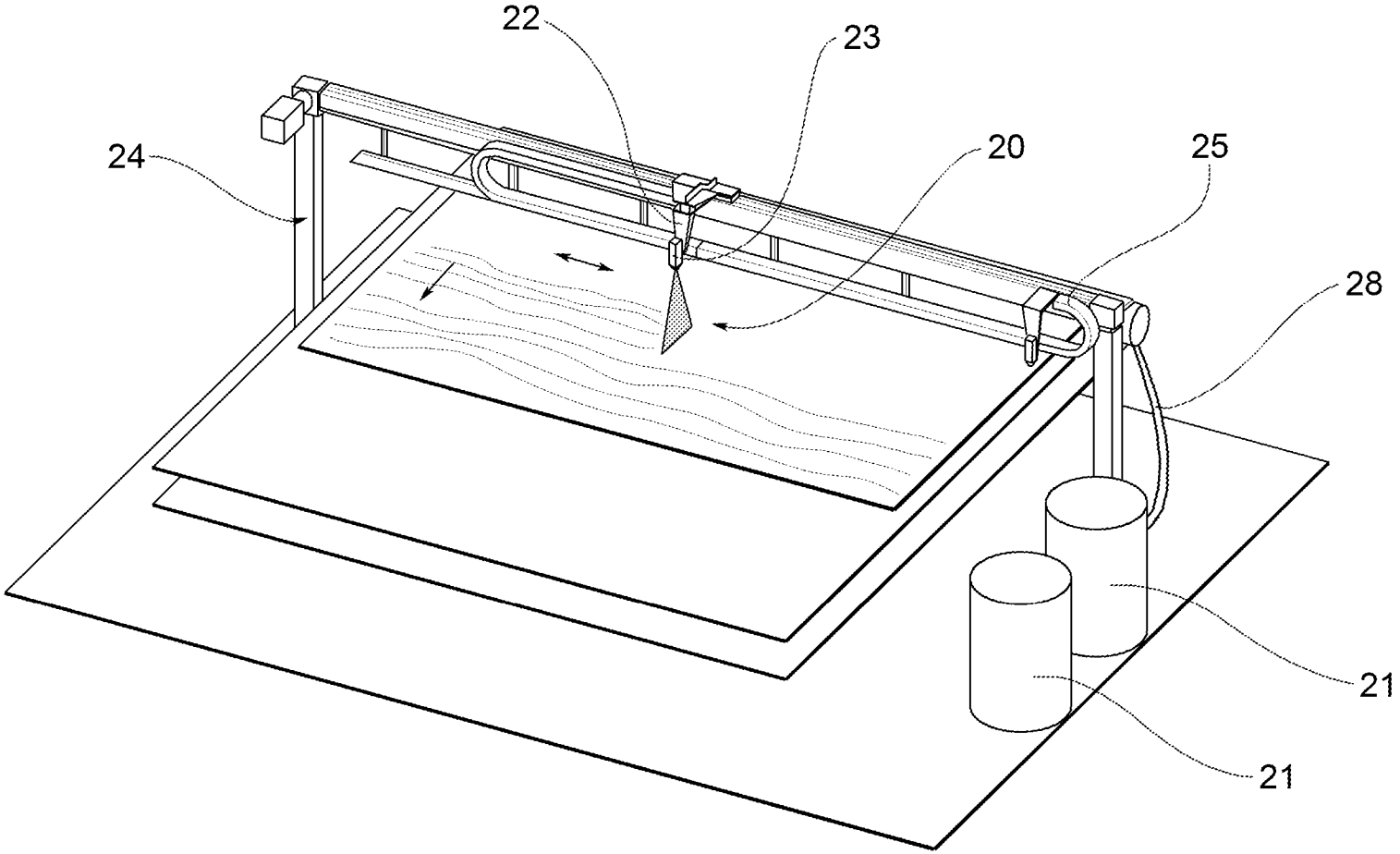
FIG. 9 diagrammatically shows a step of spray distributing a polyurethane layer for producing a support for imitation leather or for producing imitation leather according to the present invention, in a further embodiment.

With particular reference to FIGS. 8 and 9, the system 2 comprises a spraying unit 20 provided with at least one dosing pump 21.

Preferably, the dosing pump 21 has a variable ratio, with electronic control of the amount delivered and of the mixing ratio through flow controls.

The spraying unit comprises at least one high or low pressure mixing head 22 provided with at least one spray nozzle 23. The mixing head 22 and the dispenser 23 form a spray system.

Preferably, the spray system is provided with an automatic cleaning system and a mechanical purging system.

The spraying unit comprises at least one pipe 28 adapted to connect the dosing pumps 21 with the mixing head 22 of the spray system. Preferably, the pipes 28 are heated and temperature controlled with thermoregulation.

Preferably, the spraying unit is provided with a panel for adjusting the amount of product to be dispensed. The spray flow rate is variable.

Preferably, the spray system is supported above the base through a frame 24. The frame 24 is a bridge structure extending transversely above the base.

In the embodiment in FIG. 8, the spraying unit comprises a plurality of fixed spray systems (i.e., spray guns or other dispensers with fixed spray). The total number of fixed spray systems is such as to allow the complete spray coverage of the width of the base, which flows at a constant speed beneath them.

In the embodiment in FIG. 9, the spraying unit comprises a Cartesian robot 25 on which a mobile spray system (i.e., a spray gun or other movable spray dispenser) is fixed. Therefore, in such an example, the Cartesian robot allows the translation of the spray system along the frame 24 for the entire width of the base, which runs at a constant speed beneath it.

Therefore, the uniform deposition system 2 allows the two components A and B to be mixed in a liquid state, at high pressure without the need for a classic rotor or screw mixer, or at low pressure through a rotor or screw mixer.

To date, in the hypothesis of depositing the two-component mixture with the aid of a blade, it is apparent that the contact between the blade and the material under reaction (and therefore in the solidification phase) would quickly block the sliding of the two-component mixture under the blade, thus causing frequent stops for cleaning or replacing the blade itself. On the other hand, the deposition system 2 includes the spray deposition of the mixture of components A and B on the base uniformly, without the need for spreading by means of a blade. Such an aspect is particularly advantageous since it avoids the disadvantages of spreading with a blade described above, namely the need to continuously stop the process in order to clean the blade.

FIGS. 1 and 2 diagrammatically show a method of producing a support 5 for polyurethane-based imitation leather free of dimethylformamide (DMFa) or other solvents or water according to the present invention.

Such a method includes the steps of:

- preparing a base, said base being a release paper 1 or a non-stick conveyor belt 1';
- spray distributing (through the system 2) a polyurethane layer 11 on the base; such a step includes the following passages: preparing the component A and the component B; mixing the components A and B to obtain a polyurethane mixture; spray distributing the mixture uniformly on the base forming the polyurethane layer 11;

applying a backing 12 on the polyurethane layer 11 forming a support 5 to then obtain an imitation leather 6;

at least partial drying of the support 5 for imitation leather 6, formed by a layer of polyurethane 11 and the backing 12.

It should be noted that in the execution step of the method, the base 1, 1' flows through the workstations.

Preferably, the method includes a final step of rolling the support 5 for imitation leather 6 to form a roll 51.

Preferably, before the rolling step, a step of removing the base 1,1' is included so that the support 5 comprises only the polyurethane layer 11 adhered to the backing 12. In the case of using release paper 1 (FIGS. 1A, 2A), the paper is separated from the support 5 and rolled to form a roll. In the case of using a non-stick conveyor belt 1' (FIGS. 1B, 2B), such a conveyor belt is in a ring and runs continuously. Therefore, in this case, the support 5 separates from the conveyor belt which runs back to the starting station to be reused in a new production cycle.

The drying step of the polyurethane layer 11 is obtained by means of at least an oven 13.

Figure 1B:
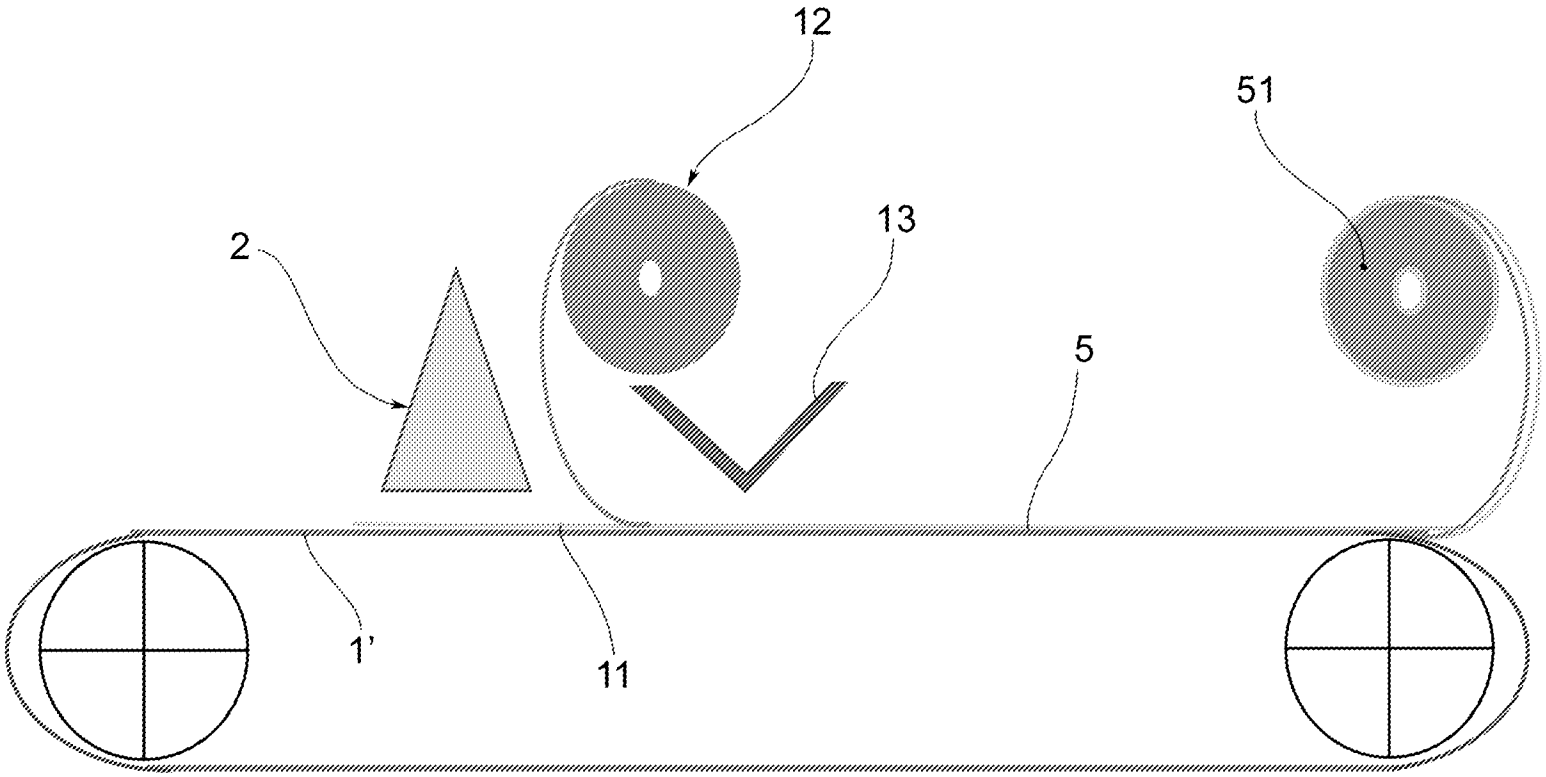
FIG. 1B diagrammatically shows a method of producing a support for imitation leather according to the present invention, in a further embodiment.

In an embodiment, shown in FIGS. 1A, 1B, the drying step of the polyurethane layer 11 is performed downstream of the backing 12 application step. In such an example the drying is complete.

Figure 2A:
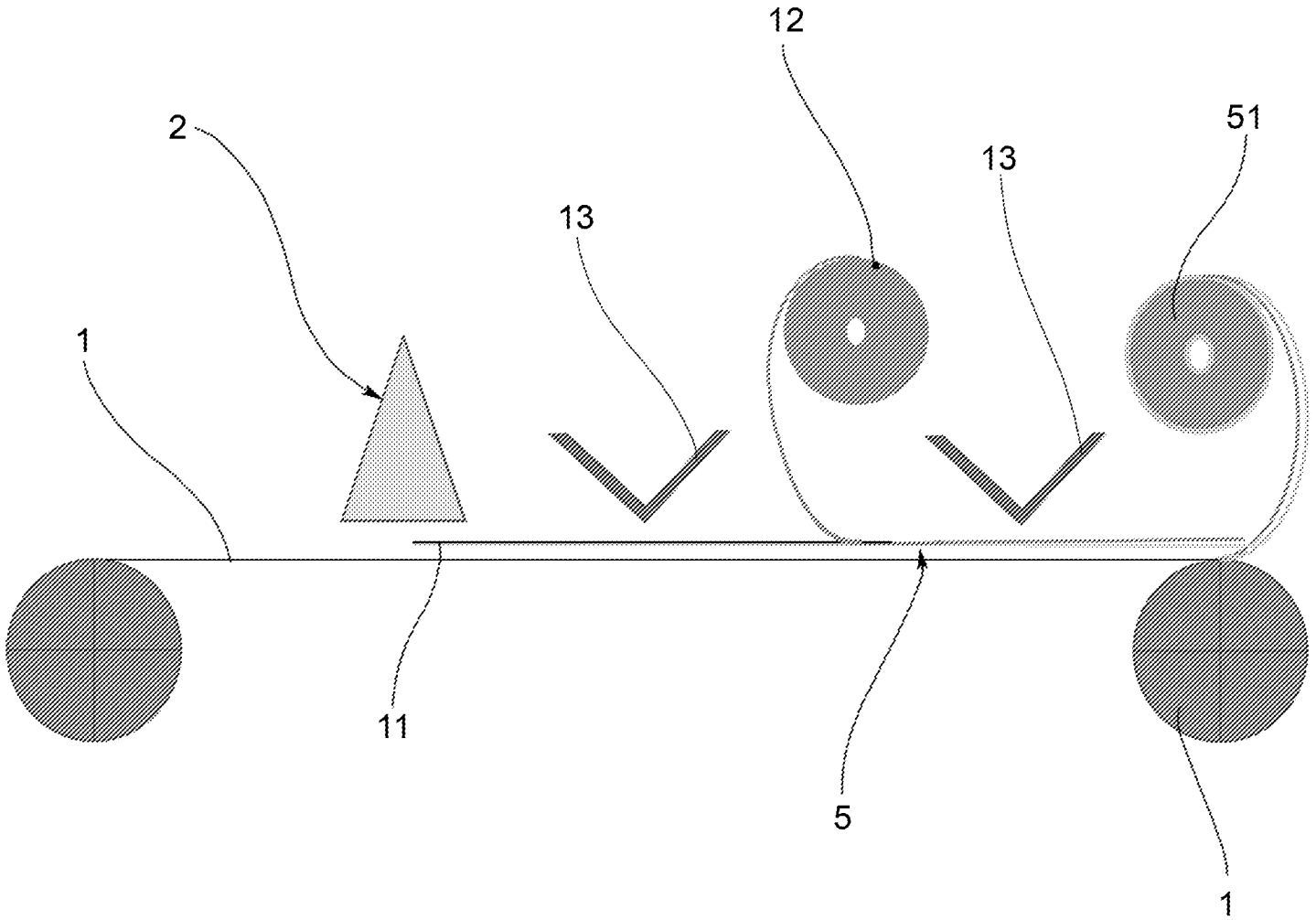
FIG. 2A diagrammatically shows a method of producing a support for imitation leather according to the present invention, in a still further embodiment.
Figure 2B:
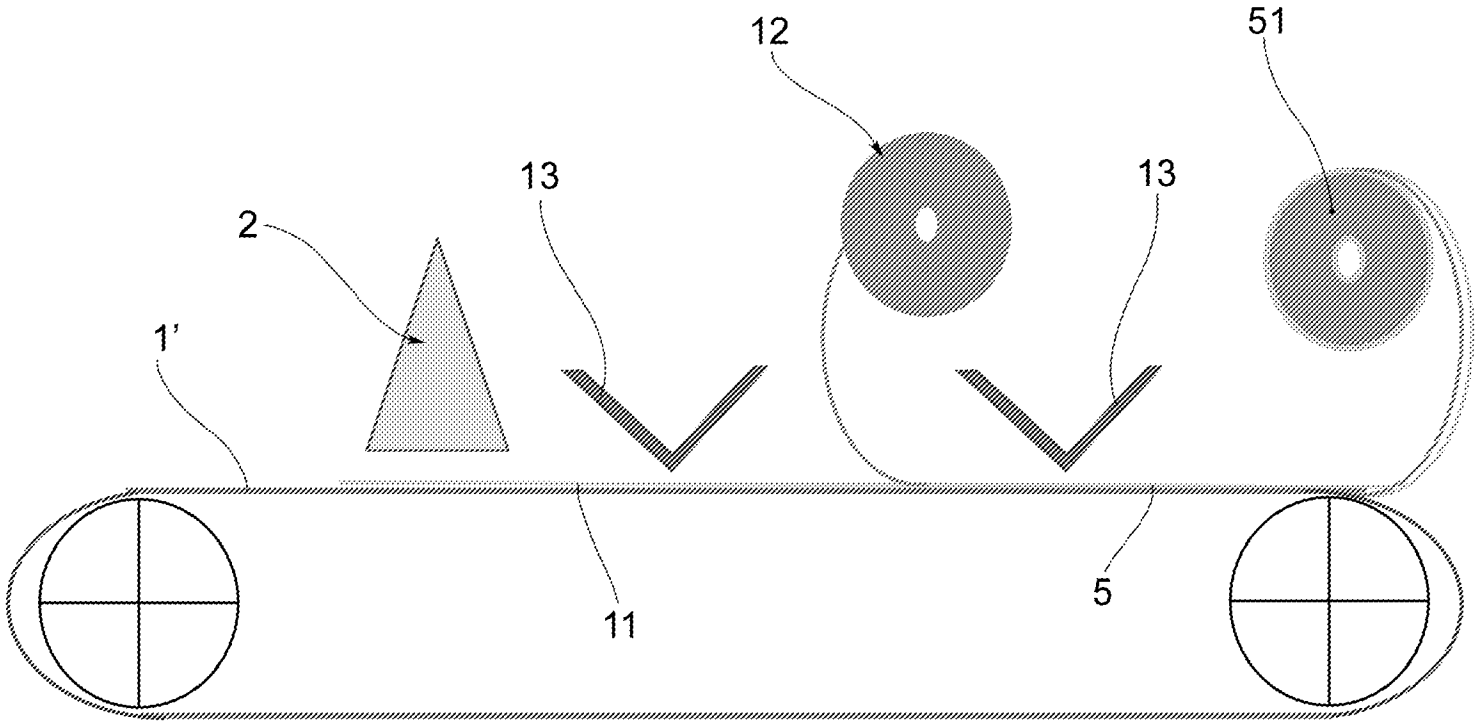
FIG. 2B diagrammatically shows a method of producing a support for imitation leather according to the present invention, in a still further embodiment.

In an embodiment, shown in FIGS. 2A, 2B, the drying step of the polyurethane layer 11 is performed upstream of the backing 12 application step. In such an example, the drying is only partial and will be completed in a further oven prepared before the support 5 is detached from the base.

Advantageously, in fact, the backing 12 is applied to the polyurethane layer 11 without the aid of adhesives since the adhesiveness of the reaction mixture is utilized.

Advantageously, the polyurethane layer 11 expands upon drying, giving thickness and mechanical properties to the support 5 for imitation leather 6.

Advantageously, by varying the amount of two-component mixture sprayed onto the base 1,1' or by varying the amount of expanding agent it is possible to obtain a more or less thick polyurethane layer 11. The thickness of the polyurethane layer 11 varies according to the final application.

It should be noted that the base is a release paper 1 (FIGS. 1A, 2A) or a non-stick conveyor belt 1' (FIG. 1B, 2B). Preferably, the release paper is provided, on the side intended to come into contact with the polyurethane layer 11, with a texture (and texture is intended as a design/grain). Solidifying, the polyurethane layer deposited on the release paper takes exactly the shape of the texture present thereon and this definition remains impressed on the polyurethane layer even after the detachment from the base. The same applies to the non-stick conveyor belt 1', provided with a design/grain on the side intended to come into contact with the polyurethane layer 11.

The backing 12 is for example a fabric or a nonwoven fabric (NWF) composed of natural or synthetic fibers or a mixture of the two.

The present invention also relates to a method of producing an imitation layer 6,6 'free of dimethylformamide (DMFa) or other solvents starting from a support 5 obtained with the above method.

FIGS. 3 to 7 diagrammatically show the method of producing the imitation leather 6, 6' according to the present invention It should be noted that in order to be able to use the support 5 to obtain an imitation leather 6,6' it is first necessary to remove it from the base 1, 1', forming the roll 51.

In an embodiment, the method of producing an imitation leather includes only spraying the two-component mixture on a base 1,1', applying a fabric/NWF 12, and a final step of removing the base. Such an embodiment is shown in FIGS. 1A, 1B, 2A, 2B.

Figure 3:
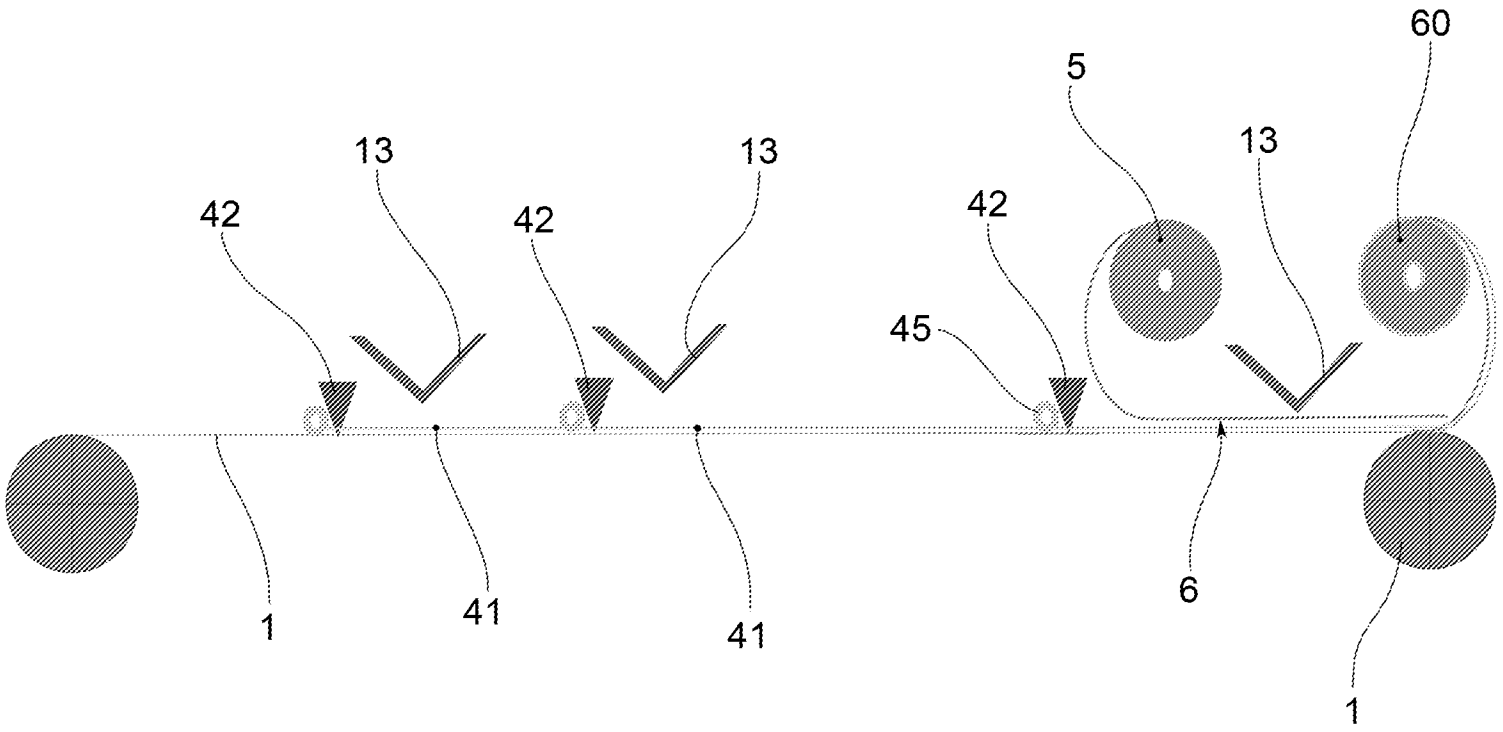
FIG. 3 diagrammatically shows a method of producing imitation leather according to the present invention, in an embodiment.

In a further embodiment, after removing the base, the support 5 obtained with the above method and therefore completely free of DMFa or other solvents or water, is inserted in a production line of imitation leather 6,6' replacing the coagulate. The support 5 thus becomes an essential element of the production process of the imitation leather 6,6' as it serves to give thickness and mechanical features to the finished product. Such an embodiment is shown in FIG. 3.

In such an embodiment, the method of producing an imitation leather 6 includes the steps of:

preparing a base, said base being a release paper 1 or a non-stick conveyor belt 1';

spreading with a blade 42 at least one polyurethane layer 41 on the base and drying the polyurethane layer 41; preferably the polyurethane is water based;

applying a layer of adhesive 45 on the last polyurethane layer 41 through a blade 42;

applying the support 5 on the adhesive layer 45; preferably the adhesive 45 is water based;

removing the base 1,1'.

It should be noted that in the execution step of the method, the base 1,1' slides.

The drying step of the polyurethane layer 41 and of the adhesive layer 45 is obtained by at least an oven 13.

Preferably, the method includes a final step of rolling the imitation leather 6 to form a roll 60.

In a further embodiment, shown in FIGS. 4 to 7, the support 5 for imitation leather is obtained with the above method directly in the production line of the imitation leather 6.

In such an embodiment, the method of producing an imitation leather 6 includes the steps of:

preparing a base, said base being a release paper 1 or a non-stick conveyor belt 1';

spreading with a blade 42 at least one polyurethane layer 41 on the base and drying the polyurethane layer 41; preferably, the polyurethane is water based;

spray distributing a polyurethane layer 11 on the last polyurethane layer 41; such a step includes the following passages: preparing the component A and the component B; mixing the components A and B at high pressure to obtain a two-component polyurethane mixture; spray distributing the mixture uniformly on the base 1,1' forming a polyurethane layer 11;

applying a backing 12 on the polyurethane layer 11;

drying the polyurethane layer 11;

removing the base 1,1'.

It should be noted that in the execution step of the method, the base 1, 1' slides.

Preferably, the method includes a final step of rolling the imitation leather 6 to form a roll 60.

The drying step of the polyurethane layer 41, 11 is obtained by means of at least an oven 13.

Figure 4:
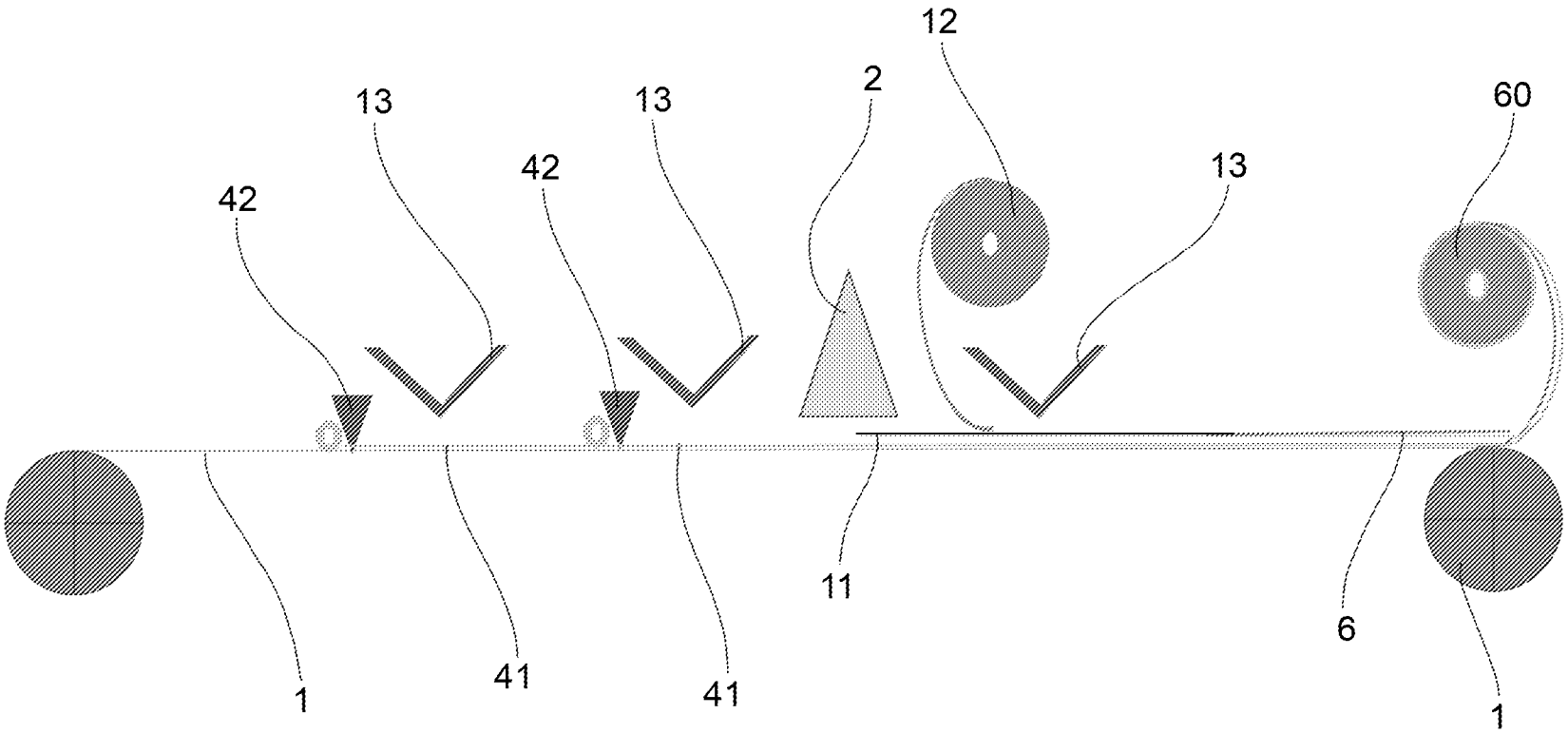
FIG. 4 diagrammatically shows a method of producing imitation leather according to the present invention, in a further embodiment.

In an embodiment, shown in FIG. 4, the drying step of the polyurethane layer 11 is performed downstream of the backing 12 application step. In such an example the drying is complete.

Figure 5:
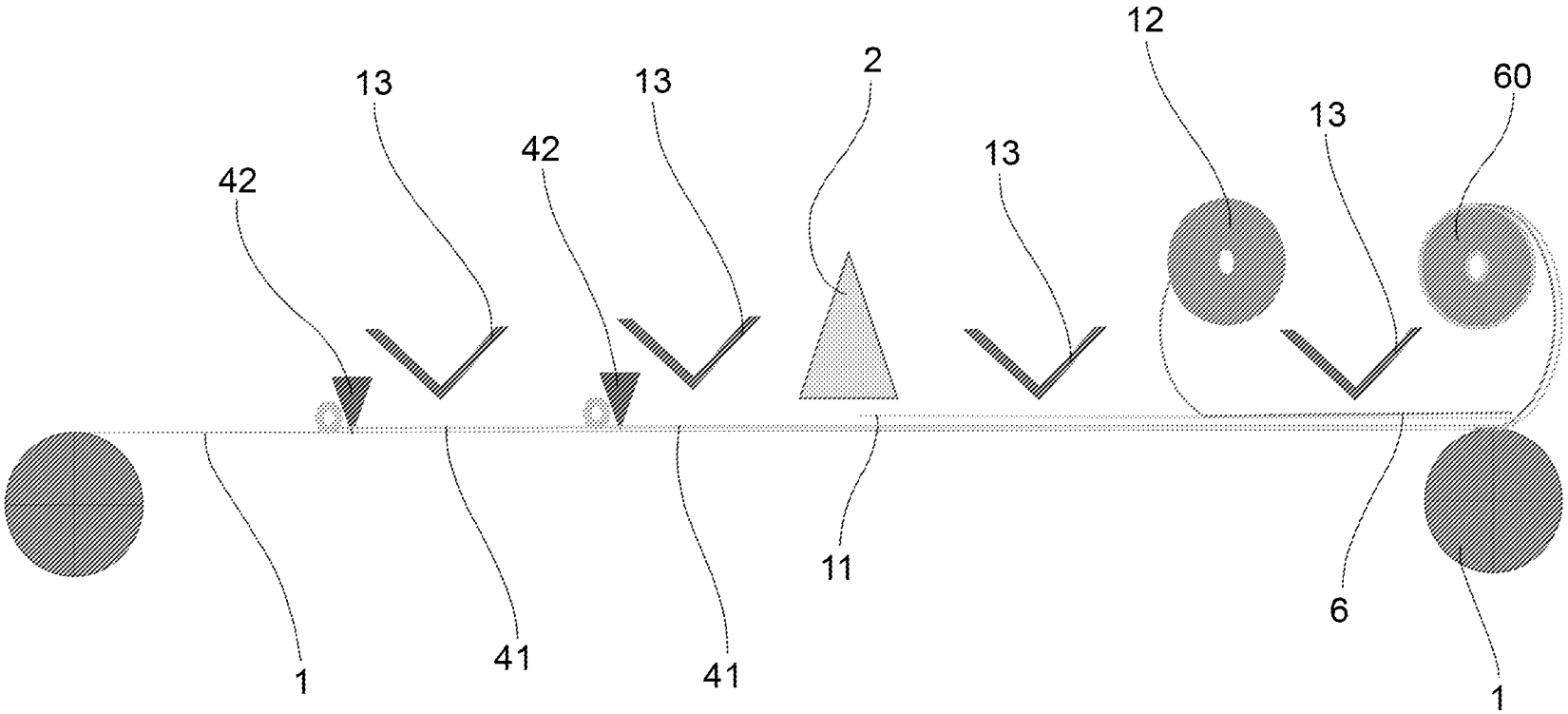
FIG. 5 diagrammatically shows a method of producing imitation leather according to the present invention, in a still further embodiment.

In an embodiment, shown in FIGS. 5, the drying step of the polyurethane layer 11 is performed upstream of the backing 12 application step. In such an example, the drying is only partial and will be completed in a further oven 13.

Figure 6:
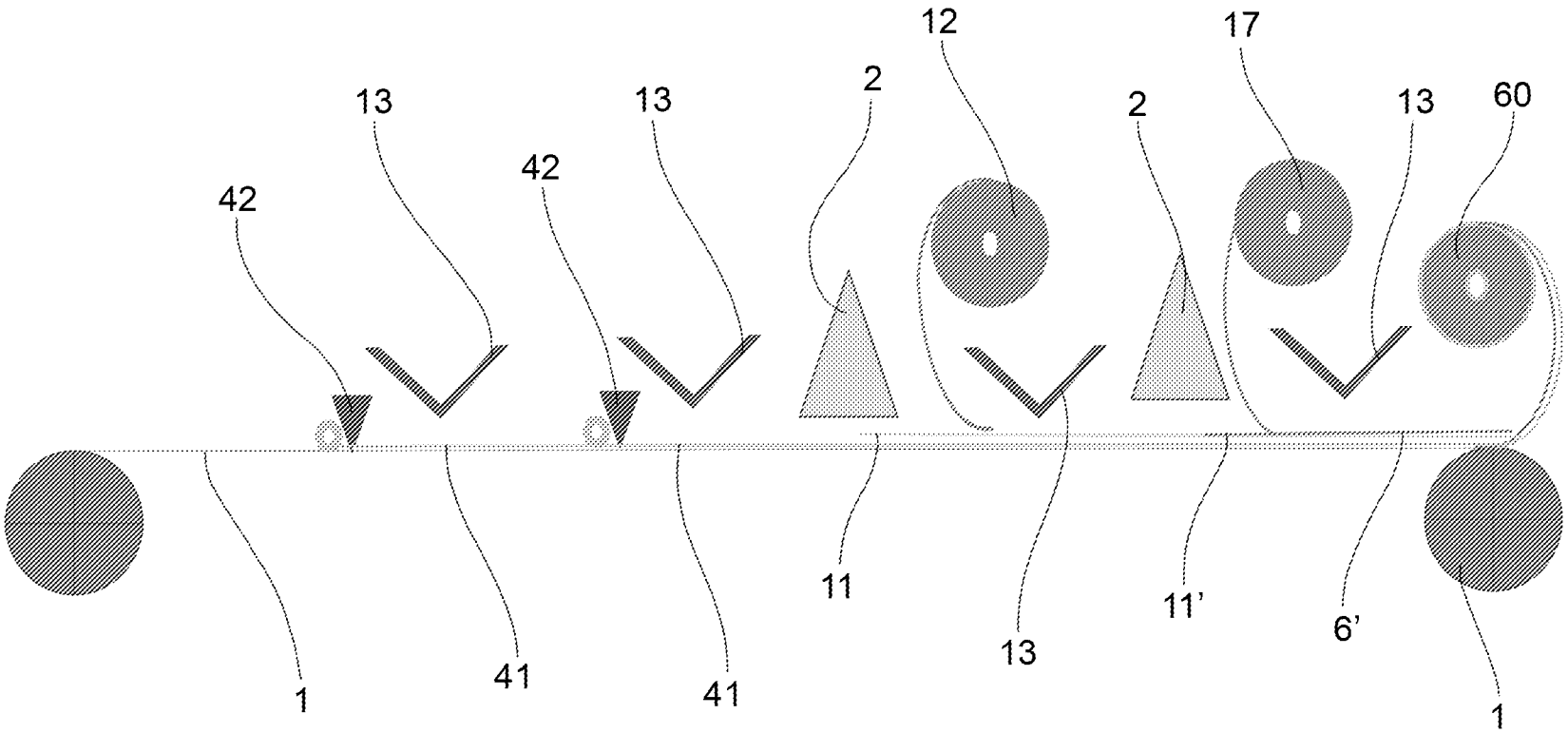
FIG. 6 diagrammatically shows a method of producing imitation leather (of the type defined on both sides) according to the present invention, in an embodiment.
Figure 7:
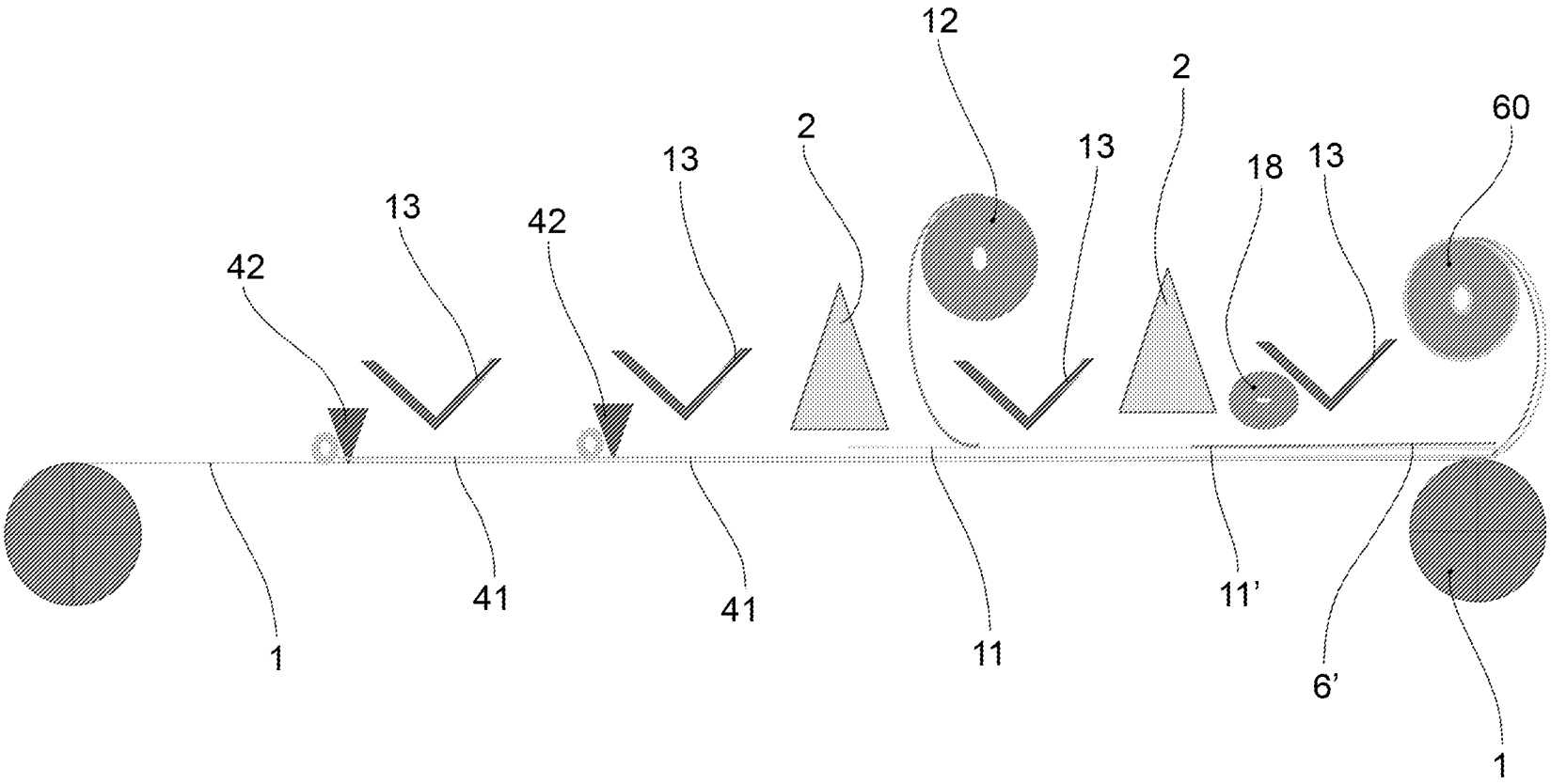
FIG. 7 diagrammatically shows a method of producing imitation leather (of the type defined on both sides) according to the present invention, in a further embodiment.

The method of producing an imitation leather according to the present invention can also be used to obtain a so-called double-coat, i.e., an imitation leather 6' defined on both sides. Such a method is shown in FIGS. 6 and 7, and includes the steps of:

preparing a base, said base being a release paper 1 or a non-stick conveyor belt 1';

spreading with a blade 42 at least one polyurethane layer 41 on the base and drying the polyurethane layer 41; preferably the polyurethane is water based;

spray distributing a polyurethane layer 11 on the last polyurethane layer 41;

applying a backing 12 on the polyurethane layer 11;

at least partial drying of the polyurethane layer 11;

spray distributing a further layer of polyurethane 11' on the backing 12;

applying a texture on the further polyurethane layer 11';

at least partial drying of the further polyurethane layer 11';

removing the base 1,1'.

In an embodiment, shown in FIG. 6, the step of applying a texture on the further polyurethane layer 11' includes applying a film 17, provided with texture, on the further polyurethane layer 11'.

In fact, the film 17 is provided with a texture, i.e., with a grain/design, on the side opposite to that intended to come into contact with the polyurethane layer 11.

Preferably, said film 17 is a polyurethane film provided with a texture. Preferably, the polyurethane is water based.

In a further embodiment, shown in FIG. 7, the step of applying a texture on the further polyurethane layer 11' includes applying a texture on the further polyurethane layer 11' by means of an embossing cylinder 18.

Preferably, before applying a texture on the further polyurethane layer 11' by means of the embossing cylinder 18, the at least partial drying of this further polyurethane layer 11' is included, for example by means of a further oven 13.

It should be noted that in the execution step of the method, the base 1, 1' slides.

Preferably, the method includes a final step of rolling the imitation leather 6' to form a roll 60.

The drying step of the polyurethane layer 41, 11, 12, 11' is obtained by means of at least an oven 13. In an embodiment, shown in FIGS. 6 and 7, the drying step of the polyurethane layer 11, 11' is performed downstream of the application step of the backing 12, or of the film 17, or of the embossing. In such an example the drying is complete.

In a further embodiment, the drying step of the polyurethane layer 11, 11' is performed upstream of the step of applying the backing 12, or the film 17, or the embossing. In such an example the drying is only partial.

A further method of producing a double-coat imitation leather, i.e., an imitation leather 6' defined on both sides, includes obtaining an imitation leather 6 with the method shown in FIG. 4 and using the roll 60 thus obtained as a support 12 for a further processing as in FIG. 4. Therefore, in such a variant, the previously obtained imitation leather 6 is deposited (on the fabric side) on the polyurethane sprayed by the machine 2, finally obtaining an imitation leather finished on both sides. Therefore, in such an example the support 12 is an imitation leather 6.

Innovatively, the method of producing a support 5 for imitation leather 6, 6', and the related machine 2, in accordance with the present invention, allows to replace the polyurethane coagulate based on DMFa or other solvents with a polyurethane support free of DMFa or other solvents or water.

It should be noted that the term spray distribution or spraying is intended as the deposition of the polyurethane layer in the form of tiny or very minute droplets or particles. Such a definition includes nebulization, atomization, vaporization, spraying, pulverization. Such a definition includes distribution both with thrust with pressurized air or compressed air, and without air. Such spraying can be carried out by using guns, or nozzles, or other dispensers capable of carrying out a spray distribution.

Advantageously, with the method of producing a support for imitation leather and with the related machine in accordance with the present invention, the polyurethane material is uniformly sprayed without the need for any mechanical spreading or leveling, for example by means of a blade or other leveling devices, and this allows to work continuously without the need for interruptions to clean hardened polyurethane residues or the maintenance of such mechanical levelers.

Advantageously, moreover, the amount of polyurethane material deposited by spraying is defined by the settings of the machine 2, with the consequent possibility of easily varying the flow rate of the material and therefore the thickness of the polyurethane layer 11 of the imitation leather 6,6'.

Furthermore, the backing 12 is advantageously applied to the polyurethane layer 11 without the aid of adhesive: in fact, the method includes utilizing the reaction of the two-component mixture and therefore the adhesiveness of the mixture to attach the backing.

Advantageously, moreover, with the method in accordance with the present invention it is possible, even without the aid of solvents or filters in general, to ensure a level of emissions which are difficult to detect with a consequent high saving of caloric energy and environmental protection.

In summary, the method in accordance with the present invention allows to replace the coagulate in a simple and less polluting manner, given the absence of any type of solvent. Furthermore, such a method allows continuous production without the need for machine stops since the deposition of the polyurethane does not require any type of mechanical leveler and related maintenance. Furthermore, such a method allows the direct line-production of all the elements forming the imitation leather, with consequent reduction of production costs and saving of industrial surface, since the coagulation line is completely eliminated. Furthermore, such a method allows huge savings in energy and raw material costs compared to the current methods which include high oven temperatures or the use of adhesives, as well as a considerable saving in CO2 emissions.

It is apparent that those skilled in the art could make changes to the subject described above, without departing from the scope of protection as defined by the following claims.

The invention claimed is:

1. A method for producing a support for polyurethane-based imitation leather free of dimethylformamide (DMFa) or other solvents or water, comprising:

preparing a base having a width;

spraying a two-component polyurethane layer on the base, the step of spraying a two-component polyurethane layer on the base comprising: preparing a first component and a second component of the two-component polyurethane layer; combining the first and second components to obtain a mixture; and spraying the mixture uniformly on the base forming the two-component polyurethane layer without a further step of leveling using a blade;

applying a backing on the two-component polyurethane layer forming a support; and drying the support;

wherein spraying the mixture uniformly on the base comprises translating a spray system along a width of the base while said base runs at a constant speed beneath the spray system.

2. The method of claim 1, wherein the first component is an isocyanate, and the second component is a polyether-based or polyester-based polyol.

3. The method of claim 2, wherein the first component is methylene diphenyl diisocyanate (MDI) partially reacted with polyesters or polyethers.

4. The method of claim 2 wherein mixing ratio by weight between the second component and the first component is between 100:30 and 100:120.

5. The method of claim 1, wherein a step of drying the two-component polyurethane layer is complete and carried out downstream of the step of applying the backing.

6. The method of claim 1, wherein a step of drying the two-component polyurethane layer is partial and carried out upstream of the step of applying the backing.

7. The method of claim 1, wherein the backing is a woven fabric or a nonwoven fabric (NWF) made of natural or synthetic fibers or a mixture thereof.

8. The method of claim 1, wherein the base has a design or grain on a side configured to come into contact with the two-component polyurethane layer.

9. The method of claim 1, wherein the base is a release paper or a non-stick conveyor belt.

10. The method of claim 1, further comprising removing the base and rolling up the support to form a roll.

11. A method for producing an imitation leather free of dimethylformamide (DMFa) or other solvents, comprising:

preparing the support for polyurethane-based imitation leather free of dimethylformamide (DMFa) or other solvents or water with the method of claim 1; and removing the base from the support.

12. A method for producing an imitation leather free of dimethylformamide (DMFa) or other solvents, comprising the steps of:

preparing a base;

spreading with a blade at least one polyurethane layer on the base and drying the at least one polyurethane layer;

applying an adhesive layer on a last polyurethane layer;

preparing a support for polyurethane-based imitation leather free of dimethylformamide (DMFa) or other solvents or water with a method comprising the steps of:

preparing a base having a width;

spraying a two-component polyurethane layer on the base, the step of spraying a two-component polyurethane layer on the base comprising: preparing a first component and a second component of the two-component polyurethane layer; combining the first and second components to obtain a mixture; and spraying the mixture uniformly on the base forming the two-component polyurethane layer without a further step of leveling using a blade, wherein spraying the mixture uniformly on the base comprises translating a spray system along the width of the base while said base runs at a constant speed beneath the spray system;

applying a backing on the two-component polyurethane layer forming a support; and drying the support;

removing the base and rolling up the support to form a roll;

applying the support on the adhesive layer; and removing the base.

13. A method for producing an imitation leather free of dimethylformamide (DMFa) or other solvents, comprising:

preparing a base having a width;

spreading with a blade at least one polyurethane layer on the base and drying the at least one polyurethane layer;

spraying a two-component polyurethane layer on the base, the spraying the two-component polyurethane layer on the base comprising: preparing a first component and a second component of the two-component polyurethane layer; combining the first and second components to obtain a mixture; and spraying the mixture uniformly on the base forming the two-component polyurethane layer without further leveling using a blade;

applying a backing on the two-component polyurethane layer;

drying the two-component polyurethane layer; and removing the base, wherein spraying the mixture uniformly on the base comprises translating a spray system along a width of the base while said base runs at a constant speed beneath the spray system.

14. The method of claim 13, wherein, for obtaining an imitation leather defined on both sides and free of dimethylformamide (DMFa) or other solvents, after drying the two-component polyurethane layer and before removing the base, the method further comprises the steps of:

spraying a further polyurethane layer on the backing; the spraying the further polyurethane layer on the backing comprising: preparing a first component and a second component of the polyurethane layer; combining the first and second components to obtain a mixture; and spraying the mixture uniformly on the backing forming the further polyurethane layer;

applying a texture on the further polyurethane layer; and drying the further polyurethane layer.

15. The method of claim 14, wherein the applying the texture on the further polyurethane layer provides for applying a film having a design or grain on a side opposite to a side configured to come into contact with the further polyurethane layer.

16. The method of claim 14, wherein the applying the texture on the further polyurethane layer comprises applying a texture on the further polyurethane layer by an embossing cylinder.

17. A method for producing an imitation leather defined on both sides and free of dimethylformamide (DMFa) or other solvents, comprising: carrying out the method for producing an imitation leather free of dimethylformamide (DMFa) or other solvents of claim 13, wherein, in relation to the applying the backing on the two-component polyurethane layer, the backing is an imitation leather produced with the method of claim 13, said imitation leather being applied on the two-component polyurethane layer on a side without texture.

18. The method of claim 12, wherein the base is a release paper or a non-stick conveyor belt, said base being provided, on a side configured to come into contact with the two-component polyurethane layer, with a design or grain.

19. The method of claim 13, wherein the base is a release paper or a non-stick conveyor belt, said base being provided, on a side configured to come into contact with the two-component polyurethane layer, with a design or grain.

20. The method of claim 13, wherein the backing is a woven fabric or a nonwoven fabric made of natural or synthetic fibers or a mixture thereof.

* * * * *